US005203263A

United States Patent [19]

Berger et al.

[11] Patent Number: 5,203,263

[45] Date of Patent: Apr. 20, 1993

[54] DEVICE FOR TRIGGERING A POSTAGE METER MACHINE

[75] Inventors: Erwin Berger, Thörishaus; Rudolf Grünig, Köniz, both of Switzerland

[73] Assignee: Ascom Autelca AG, Bern, Switzerland

[21] Appl. No.: 793,440

[22] PCT Filed: Feb. 19, 1991

[86] PCT No.: PCT/CH91/00041

§ 371 Date: Nov. 4, 1991

§ 102(e) Date: Nov. 4, 1991

[87] PCT Pub. No.: WO91/14238

PCT Pub. Date: Sep. 19, 1991

[30] Foreign Application Priority Data

Mar. 14, 1990 [CH] Switzerland ..... 00835/90

[51] Int. Cl.[5] ..... B41J 45/00

[52] U.S. Cl. ..... 101/76; 400/56; 101/91; 101/235; 271/274

[58] Field of Search ..... 101/76, 91, 232–235; 400/56, 642, 645, 645.4; 271/274, 265

[56] References Cited

U.S. PATENT DOCUMENTS

| | | | |
|---|---|---|---|
| 4,361,399 | 11/1982 | Sawada et al. | 271/274 |
| 4,437,780 | 3/1984 | Weber et al. | 400/642 |
| 4,620,807 | 11/1986 | Polit | 400/56 |
| 4,630,950 | 12/1986 | Chu et al. | 400/645 |
| 4,705,413 | 11/1987 | Arnold et al. | 400/56 |
| 4,763,575 | 8/1988 | Miciukiewicz | 101/2.33 |
| 4,884,503 | 12/1989 | Nobile | 101/91 |
| 4,990,003 | 2/1991 | Jingu et al. | 400/56 |
| 5,061,095 | 10/1991 | Asai et al. | 400/56 |
| 5,087,135 | 2/1992 | Tew et al. | 400/56 |

*Primary Examiner*—Eugene H. Eickholt
*Attorney, Agent, or Firm*—Horst M. Kasper

[57] ABSTRACT

The apparatus comprises two levers (80, 81), which are rotatable around rigid axles (86, 87). Added to this is a third rigid axle (85), which carries the one lower infeed roller (21.2). The upper infeed roller (21.1) is supported at a lever (80) and is springingly pressed against the lower infeed roller (21.2). The apparatus permits letters to be postage metered run in direction of the arrow (52) and thereby press the two infeed rollers (21.1, 21.2) apart from each other up to a maximum width D.

In operation one lever (80) carries a bolt (95) at an arm (94), where the bolt (95) engages into a curved slot (98) of the other lever (81). The bolt (95) freely moves in the curved slot (98) between zero and a with of, for example, 3 mm. In case of a larger width, the bolt (95) impacts at the edge of the slot and presses the other lever (81) in direction of the dashed illustrated deflection position. Other lever (81) has a release hole (99). The release of the postage meter machine occurs by the release fork (22), which is rotatably attached in an elongated hole (99) of the other lever (81). The respective release point in time is shifted based on the deflection of this lever (81), whereby the imprints of the postage meter stamp occurs later in case of thick letter envelopes, as compared to thin letter envelopes. This effects an improvement of the imprint quality on the letter envelopes.

8 Claims, 4 Drawing Sheets

DEVICE FOR TRIGGERING A POSTAGE METER MACHINE

The invention relates to a device for the triggering of a postage meter machine according to the preamble of claim 1.

Postage meter machines are presently used worldwide and are therefore well known. A description of such a machine can be found, for example, in Hasler Review 11 (1978), No. 1, 2–7, R. Grünig, "Hasler Mailmaster F204 Franking Machine".

Figure 1:
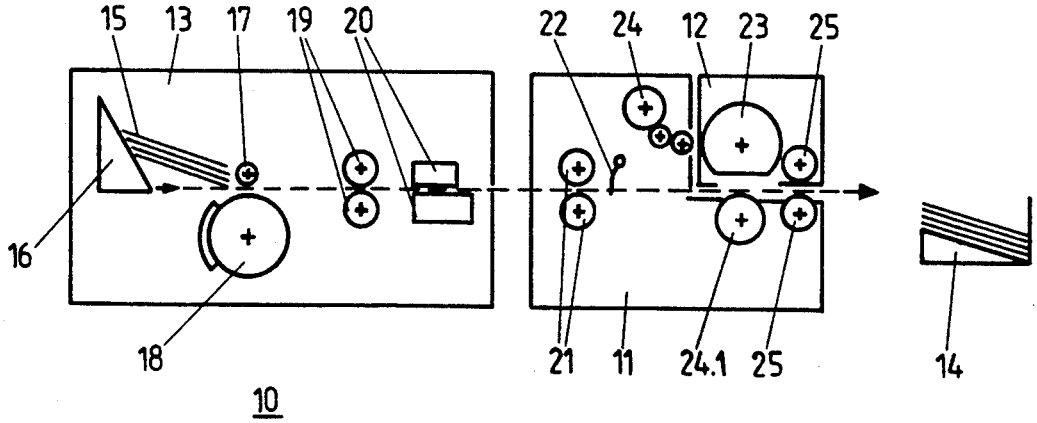
Fig. 1 (PRIOR ART)
Figure 2:
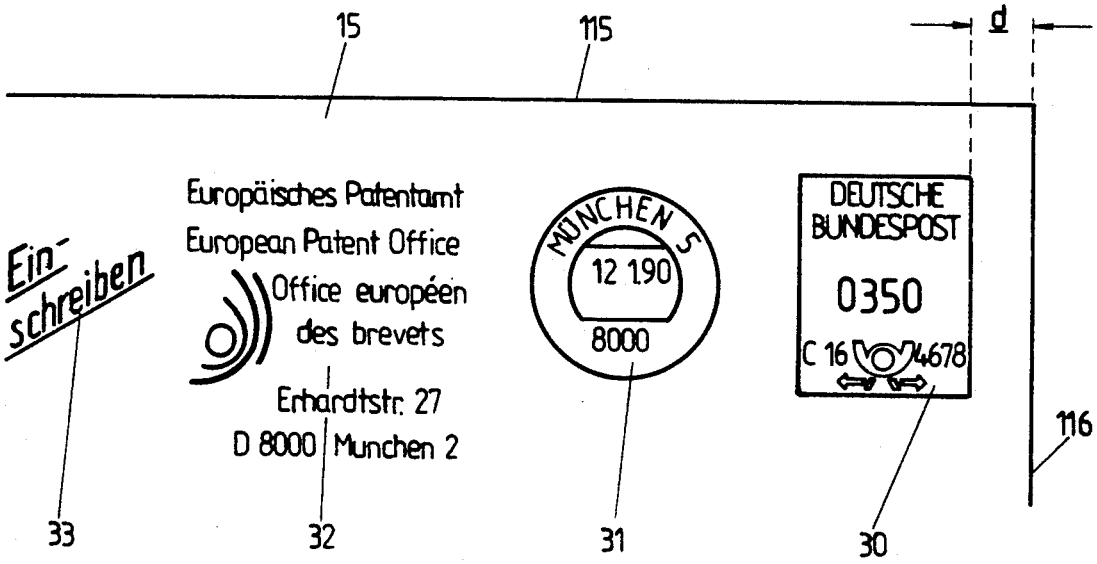
Figure 3:
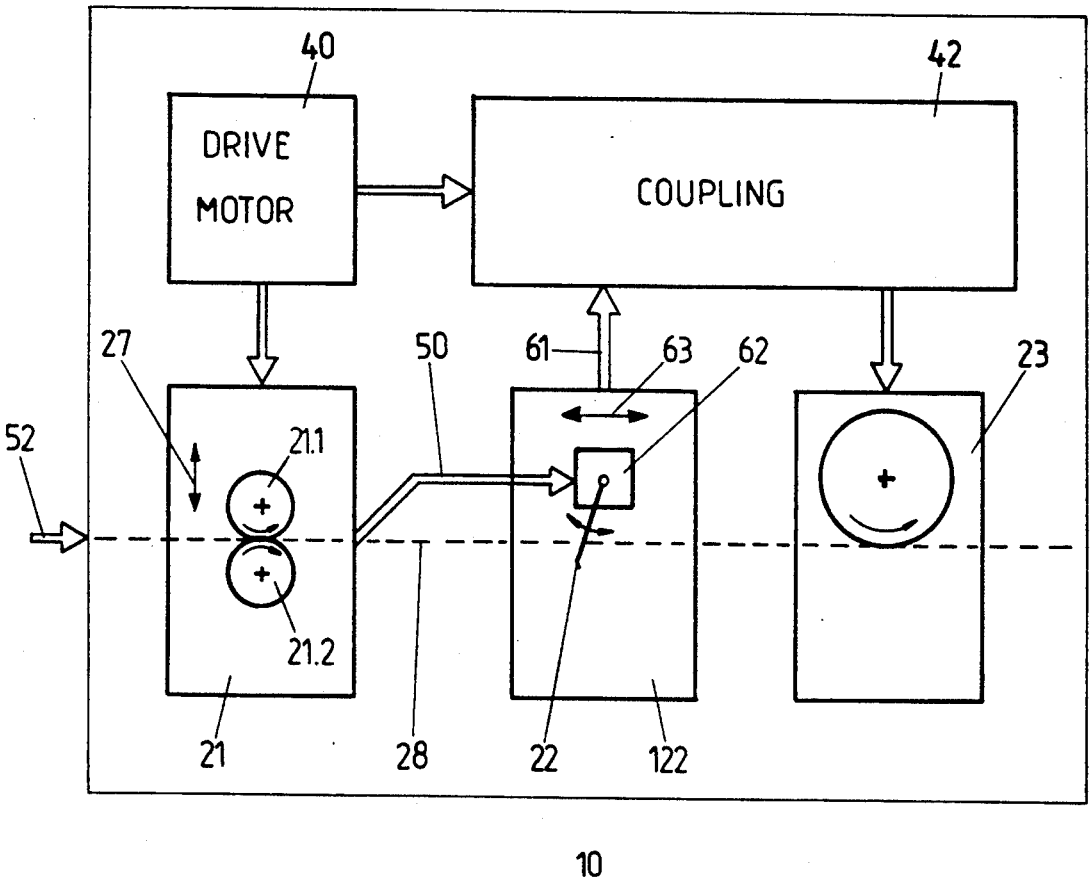
Figure 4:
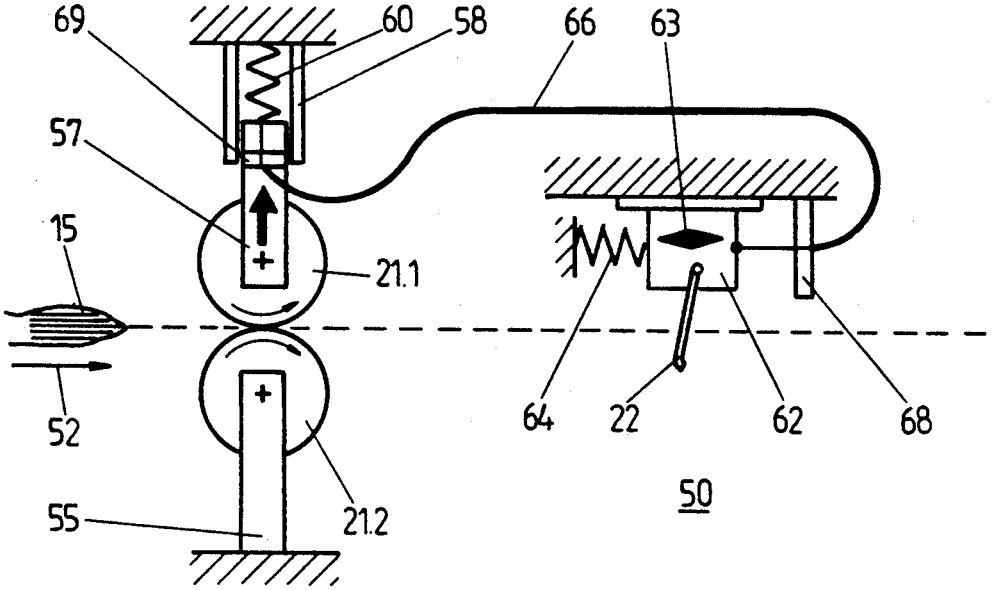
Figure 5:
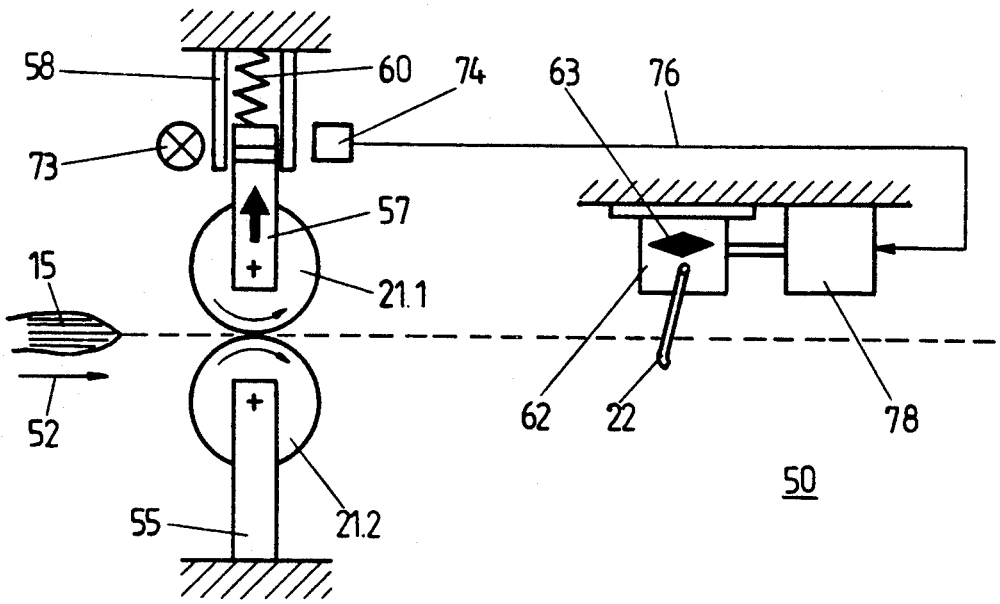
Figure 6:
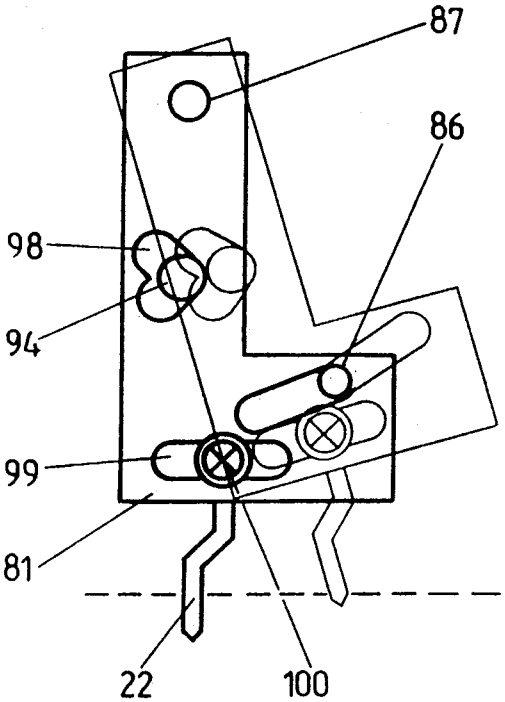
Figure 6:
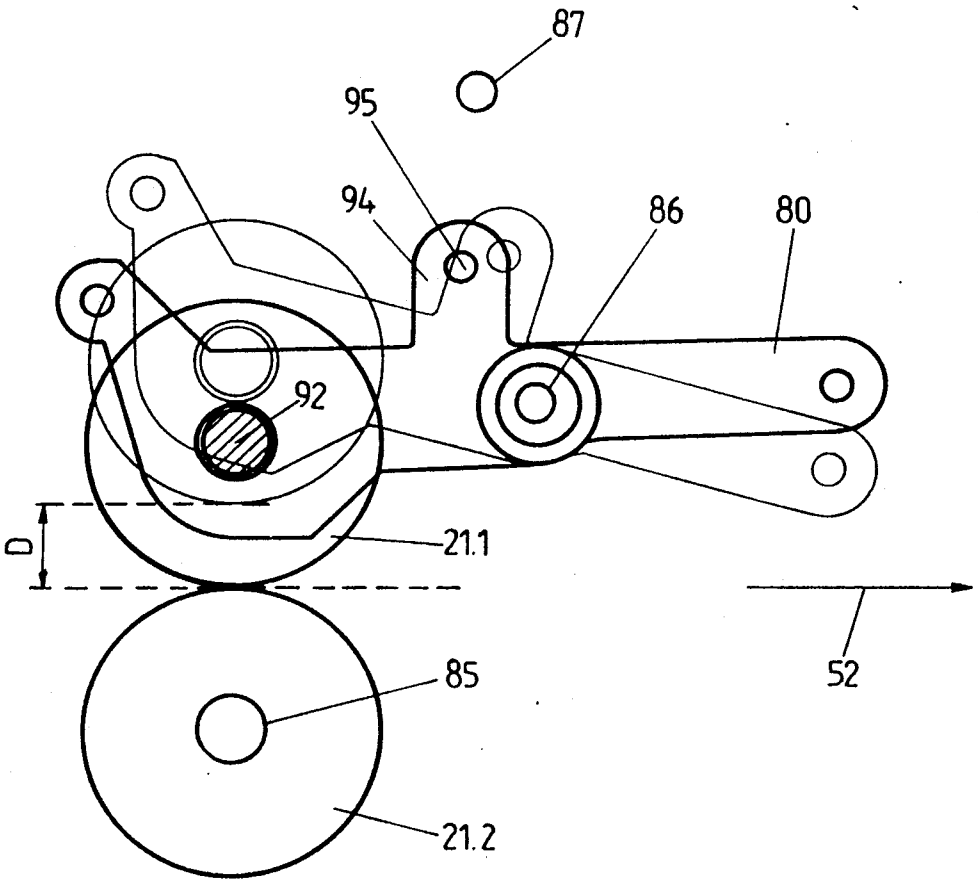

This is shown in:

FIG. 1 a schematic side elevational view of a postage meter machine modularly formed of a drive unit, a franking unit, and a feed apparatus, FIG. 2 a copy of an exemplified imprint of a postage meter machine onto a mail piece, in particular onto a letter, FIG. 3 a schematic view of a block circuit diagram of a drive unit and a franking unit of a postage meter machine, FIG. 4 a schematic view of a first embodiment of a power connection, FIG. 5 a schematic view of a second embodiment of a power connection, FIG. 6 a schematic view of a third embodiment of a power connection.

A postage meter machine 10 is illustrated in FIG. 1 according to this description as state of the art, where the postage meter machine 10 is modularly formed of a drive unit 11, a franking unit 12, and a feed apparatus 13. Added is a collection container 14. The mail pieces 15 to be franked, for example, filled letter envelopes, are disposed as a stack between an insertion wedge 16 and a separator 17. A rotating feed segment 18 pulls consecutively the respective lowest letter toward the right hand side and conveys it to a transport roller pair 19 and to an envelope sealer 20. A infeed roller pair 21 grips the mail piece 15 in the drive unit 11. This mail piece 15 thereby actuates a release fork 22, which is in power connection with a drive, where the drive in turn rotates a print rotor 23 one single time. An inking device 24 inks the print rotor 23 during this rotation, whereupon the print rotor 23 rolls off on the passing letter and thereby places the postage meter stamp. A counter pressure roller 24.1 supports in this case the mail piece 15, independent of the thickness of the mail piece. The letter is then thrown with two discharge rollers 25 into the collection container 14.

An exemplified imprint of a postage meter machine 10 onto a mail piece 15, in particular onto a letter, is illustrated in FIG. 2. The print comprises a value stamp 30, a date stamp 31, and two informative stamps 32, 33. These stamps are to be affixed as a clear print as parallel as possible to the upper edge 115 of the respective mail piece 15, according to the prevailing postal regulations, and they are to be positioned at a favorable distance d from the insertion edge 116. The distance d amounts in case of thin letters, for example, to 10 mm.

As practical use has shown, the distance d varies dependent on the operating speed of the respective postage meter machine 10. If the machine is furnished with a quicker passage than a like constructed, however, slower machine, then the imprint slides towards the left on the envelope, i.e. the distance d becomes larger. The postage meter machines 10 therefore are furnished with an adjustment possibility for adjusting the respectively desired release position of the release fork 22. The recited dependence of the distance d on the operating speed of the respective machine can be quickly balanced and adjusted.

Practical use has further shown that the position and the quality of the value stamp 30 depends on the thickness of the respective mail piece 15.

Therefore, it is an object of the invention to furnish a device, which assures a consistently uniform print quality for any kind of mail piece, i.e., for thin and thick letters, adhesive labels, post cards, and the like.

The solution of this object is given by the characterizing features recited in claim 1. The remaining claims furnish embodiments of the invention. The solution fulfills in this manner the recited object, which object corresponds to an improvement of a correspondingly equipped postage meter machine 10.

The invention is described in the following by way of four additional figures, by way of example.

There is shown in

FIG. 3, a simple block circuit diagram of a drive unit 11 and a franking unit 12 of a postage meter machine 10;

FIG. 3 illustrates a simple block circuit diagram of the drive unit 11, known according to FIG. 1, and of the franking unit 12 of a postage meter machine 10. This machine comprises an infeed roller pair 21, a release trigger 122 with a release fork 22, a drive motor 40, a coupling 42, and a print rotor 23. These units are connected to each other by power transmitting connections, where the power transmitting connections are represented by beam arrows.

The drive motor 40 runs continuously and thereby drives the infeed roller pair 21. The rollers 21.1 and 21.2 of the infeed roller pair 21 are disposed vertically on top of each other. The lower roller 21.2 is rigidly supported, whereas the upper roller 21.1 is springingly suspended, such that the upper roller 21.1 presses elastically against the lower roller 21.2 in a rest position. As soon as a mail piece 15 is pulled in horizontally in the direction of the arrow 52, then this mail piece is springingly clamped between the two rollers. The different distance of the rollers 21 set thereby in each case thus corresponds to the thickness of the respective mail piece 15. The springing suspension of the upper roller 21.1 is indicated by a vertical double arrow 27.

The drive motor 40 further continuously drives a part of the coupling 42. The coupling 42 is formed, for example, as a loop spring coupling, which is mechanically triggered by the release trigger 122 (arrow 61). The print rotor 23 starts to accelerate from the rest position, to rotate with a constant speed, and to brake for reaching the rest position as soon as the coupling 42 engages. The rotor thereby performs one single complete rotation.

Each time a mail piece 15 crosses the postage meter machine 10 on the passage path 28, illustrated with a broken line then the release fork 22 of the release trigger 122 is actuated as was described in connection with FIG. 1. The print rotor 23 thereby operates in a pure start/stop operation, which is controlled by the mail pieces 15 via the release trigger 122 and the coupling 42.

The release fork 22 is rotatably supported at a slideable support 62. The release fork 22 hangs downwardly with its free end. The axle of the release fork 22 is connected via a flexible shaft (not illustrated) to the coupling 42, which is symbolically illustrated by way of the recited arrow 61. Upon rotation via this shaft the release fork 22 releases each time the coupling 42. The release fork 22 is preferably furnished with two or more identical and rigidly interconnected levers and prongs or tines, respectively, which are disposed cross to the passage path 28. The support 62 can be linearly slid in the direction of the passage path 28, which passage path 28 is indicated by the double-end arrow 63. The support 62 is further connected by a power connection 50 to the infeed roller pair 21, which infeed roller pair 21 is illustrated by a correspondingly designated beam arrow.

The power connection 50 furnishes a force transmitting connection preferably of a mechanical kind. The power connection 50 operates such that the trigger position of the release trigger 122 is shifted in the direction of the passage of the mail piece 15, i.e. in the representation of FIG. 3 toward the right hand side, if the mutual distance of the infeed rollers 21.1, 21.2 is increased. If this distance is again decreased, then the trigger position is shifted opposite to the recited direction of the arrow 52, i.e. toward the left-hand side.

FIG. 4 illustrates a first embodiment of the power connection 50. The one infeed roller 2, and in particular the lower infeed roller 21.2 is spatially fixedly supported at support 55. The other, upper infeed roller 21.1 is supported via support arm 57 and a guide 58 in a linear slideable position. A compression spring 60 presses the upper infeed roller 21.1 elastically against the lower infeed roller 21.2. The two infeed rollers 21 rotate in the direction of the arrow and pull in the respective mail piece 15 in the direction of the arrow 52. A thicker envelope is illustrated, for example, in FIG. 4 as a mail piece 15 together with a plurality of sheets of paper disposed within the thicker envelope.

The release fork 22 is formed according to FIG. 3 as a unilaterally supported lever, where the free end of the lever is protruding downwardly. The release fork 22 is rotatably attached at the support 62, The support 62 is supported linearly displaceable in the direction of the double-end arrow 63. A pretensioned tension spring 64 pulls the support 62 continuously in the direction of the infeed rollers 21. The support arm 57 and the support 62 are force-transmittingly connected via a Bowden train 66, where the Bowden train is supported by two coordinated supports 68, 69.

The described first embodiment of the power connection 50 employs the Bowden train 66 as a flexible, mechanical connection element. This is a functionally clear, but relatively expensive way from a practical point of view.

FIG. 5 illustrates a second embodiment of the power connection 50. In this case, a light barrier 73, 74 cooperates with the displaceably supported support arm 57. This light barrier responds as soon as a predetermined deflection of the support arm 57 is reached. The resulting electrical response signal is transferred via the connection 76 to an electromechanical converter 78, for example, to a pull tension armature magnet. This pull tension armature magnet thereby shifts in each case the support 62 in the direction of the double-end arrow 63 towards the right-hand side.

According to a first embodiment illustrated in FIG. 4, there exists a linear connection of a ratio 1:1 between the motion of the support arm 57 and the motion of the support 62. In contrast, according to a second embodiment illustrated in FIG. 5, a threshold of a most simple kind is employed, which threshold knows only two states, i.e. support 62 "not displaced" and support 62 "displaced", respectively.

A third preferred embodiment of the power connection 50 is illustrated in FIG. 6. This preferred embodiment comprises a combination of two rotatably supported levers 80 and 81 which, for purposes of clarity, are illustrated side by side and separate from each other. The respective rest position is thereby drawn with full lines and the maximum deflection position is illustrated with dashed lines.

The fixing points of the arrangement are formed by three spatially fixed by disposed axles 85, 86, 87, where the sections of the axles 85, 86, 87 are illustrated with their full face in black. The lower infeed roller 21.2 of the infeed roller pair 21 is supported on the first axle 85, the first lever 80 is supported on the second axle 86, and the second lever 81 is supported on the third axle 87. This second lever is simultaneously inserted over the second axle 86 via an elongated hole 89. (According to the selected mode of representation, the axles 86 and 87 are in each case illustrated two times.)

The first lever 80 carries and supports a fourth axle 92, where the upper infeed roller 21.1 of the infeed roller pair 21 is supported on the fourth axle 92. The lever 80 is spring-loaded to such an extent that this upper infeed roller 21.1 presses continuously elastically from the top against the lower, rigidly supported first infeed roller 21.2. Each mail piece 15, passing in the direction of the arrow 52, presses, corresponding to its thickness, the upper infeed roller 21.1 against the weight of the upper infeed roller 21.1, and the recited spring force in an upward direction. The maximum deflection is indicated with the letter D and amounts, for example, to about 12 mm. Based on the deflection of the infeed roller 21.1, the first lever 80 rotates around the second axle 86, at a maximum up to the dashed illustrated maximum deflection.

The first lever 80 now exhibits an upwardly protruding arm 94, which supports a bolt 95, where the bolt 95 is directed parallel to the axles 85, 86, 87, 92. This bolt 95 engages into a curved slot 98 of the second lever 81 and, in fact, with a small play. The curved slot 98 is dimensioned and directed such that the bolt 95 freely moves in this curved slot 98 in case of a slight deflection of the first lever 80 or, respectively, in case of a slight rotation of the protruding arm 94 around the second axle 86, without changing the second lever 82 in its base position.

However, if the deflection, based on a mail piece 15 of a thickness of, for example, more than 3 mm, surpasses the length of the free region, then the bolt 95 reaches the upper part of the curved slot 98 and shifts the second lever 81, dependent on the thickness of the mail piece 15, more or less in direction of the dashed illustrated maximum deflection position.

The second lever 81 is furnished at its lower end with another elongated hole 99. The release fork 22 is attached in this further elongated hole 99 and in fact such that, in each case, the fixed position can be selected individually and corresponding to the operating speed for each postage metering machine 10. The release fork 22 itself is rotatable around the fixed point 100 and is connected to the coupling 42 via the flexible shaft, not illustrated. The coupling 42 effects after each release of the postage metering machine 10 the resetting of the release fork 22 into the base position of the release fork 22, where the release fork 22 again is directed vertically downwardly, as is illustrated.

According to a third embodiment of the power connection 50, the second lever 81, as can be seen, corresponds to the recited support 62, illustrated in FIGS. 3, 4, 5. In this connection, the linear, horizontal displaceability of the support is replaced by the rotation of lever 81 around the third axle 87. The elongated hole 99 in the lever 81 allows, as described, the individual fixing of the position for the release point of the release fork 22. The elongated hole 99 thus forms together with a fixing screw an adjustment device for the precision adjustment of the distance d of the value stamp 30 from the insertion edge from the mail piece 15 having a small thickness, as illustrated in FIG. 2.

In addition to the various embodiments recited, the following embodiments are also possible:

Instead of the upper infeed roller 21.1, the lower infeed roller 21.2 can be flexibly supported, or both rollers are deflectable.

The recited free region in the curved slot 98 of FIG. 6 can, as described, amount to 3 mm, however, the recited free region can also be shorter or longer. In general, the dependency of the shifting of the support 62, on the thickness of the mail piece 15, can be proportional, can be disproportional, or can only be proportional from a certain thickness of the mail piece 15.

The release trigger 122 does not comprise a mechanically actuatable release fork 22, but instead an electrical sensor, for example, a light barrier or another contactless detector.

Instead of being moved linearly or along a circular line, the support 62 can be moved along a differently curved shape. The release trigger 122 has to be mounted such that it moves substantially parallel to the running direction of the mail piece 15.

We claim:

1. Apparatus for triggering of a postage meter machine (10), comprising an infeed roller pair (21), where infeed rollers (21.1, 21.2) of the infeed roller pair (21) are spring-loadedly held together, and wherein the rollers (21.1 and 21.2) form a passage for mail pieces (15) of variable thickness, a release trigger (122) actuatable, in each case, by a mail piece (15) for initiating in each case one single rotation of a print rotor (23), and an adjustment device for a fine adjustment of a release position of the release trigger (122), characterized by a support (62), which supports the release trigger (122) and which is displaceable parallel to a passage path (28) of the mail pieces (15), and a power connection (50), which connects the infeed roller pair (21) and a support (62) such that the release position of the release trigger (122) is shifted in motion direction of the mail piece (15), if a mutual distance of the infeed rollers (21.1, 21.2) is increased, and where the release position of the release trigger (122) is shifted opposite to said motion direction, if the recited distance is decreased.

2. Apparatus according to claim 1, wherein the infeed rollers (21.1, 21.2) of the infeed roller pair (21) are disposed vertically on top of each other, wherein the lower infeed roller (21.2) is disposed rigidly, and wherein the upper infeed roller (21.1) is disposed deflectable in an upward direction.

3. Appratus according to claim 1, wherein the power connection (50) is formed as a Bowden train (66).

4. Apparatus according to claim 1, wherein the support (62) is formed as a lever (81), which lever (81) is rotatably supported on a fixedly disposed axle (87) and wherein the lever (81) exhibits a curved slot (98), wherein the power connection (50) comprises a further lever (80), which further lever (80) is rotatably supported at a further fixedly disposed axle (86), wherein the lever (80) supports the upper infeed roller (21.1), wherein the lever (80) is spring-loaded such that the upper infeed roller (21.1) presses elastically against the lower, rigidly supported infeed roller (21.2), and wherein the lever (80) is furnished with an arm (94), which arm (94) carries a bolt (95), and wherein the bolt (95) engages into the curved slot (98) for the purpose of connecting the two levers (80, 81).

5. Apparatus according to claim 4, wherein the curved slot (98) is formed such and directed such that the bolt (95) engages into the curved slot (98) with a slight play, wherein the bolt (95) moves freely in the curved slot (98) in case of a distance of the infeed rollers (21.1, 21.2) between zero and a fixed detent value, and wherein, in case of a distance which surpasses the detent value, the bolt (95) impacts at the wall of the curved slot (98) and presses the lever (81), serving as a support (62), from its rest position.

6. Apparatus according to claim 4, wherein the lever (81), serving as a support (62), is furnished with an elongated hole (99), which elongated hole (99) serves for a fine adjustment of the release position of the release trigger (122).

7. Apparatus according to claim 1, wherein the release trigger (122) includes a rotably suspended, mechanically actuatable release fork (22).

8. Apparatus according to claim 1, wherein the release trigger (122) comprises a contactless sensor for delivering an electric release signal.

* * * * *